US010328467B2

(12) United States Patent
Johnson et al.

(10) Patent No.: US 10,328,467 B2
(45) Date of Patent: Jun. 25, 2019

(54) AUTOMATIC CLEANING AT A SELF-SERVICE DISPENSING DEVICE

(75) Inventors: Mark Johnson, Lawrenceville, GA (US); Gregg Fallon, Cumming, GA (US); Tommy Williams, Alpharetta, GA (US); Kenn Armstrong, Lawrenceville, GA (US); Dave Gregerson, Lawrenceville, GA (US)

(73) Assignee: NCR Corporation, Atlanta, GA (US)

( * ) Notice: Subject to any disclaimer, the term of this patent is extended or adjusted under 35 U.S.C. 154(b) by 171 days.

(21) Appl. No.: 13/326,545

(22) Filed: Dec. 15, 2011

(65) Prior Publication Data

US 2013/0167311 A1 Jul. 4, 2013

Related U.S. Application Data

(60) Provisional application No. 61/425,035, filed on Dec. 20, 2010.

(51) Int. Cl.

| | |
|---|---|
| ***A47L 13/17*** | (2006.01) |
| ***B08B 1/00*** | (2006.01) |
| ***B08B 1/02*** | (2006.01) |
| ***G07F 19/00*** | (2006.01) |
| ***G07F 7/00*** | (2006.01) |
| ***G07F 7/08*** | (2006.01) |

(52) U.S. Cl.

CPC ..... *B08B 1/006* (2013.01); *B08B 1/02* (2013.01); *G07F 7/005* (2013.01); *G07F 7/0873* (2013.01); *G07F 19/201* (2013.01); *A47L 13/17* (2013.01)

(58) Field of Classification Search

CPC ..... A47L 13/17
USPC ..... 401/132, 196, 198; 15/104.93, 104.94
See application file for complete search history.

(56) References Cited

U.S. PATENT DOCUMENTS

| | | | | |
|---|---|---|---|---|
| 2,209,544 | A * | 7/1940 | Seeberger | 401/23 |
| 4,159,883 | A * | 7/1979 | Mizell | 401/201 |
| 4,430,013 | A * | 2/1984 | Kaufman | 401/132 |
| 4,961,661 | A * | 10/1990 | Sutton et al. | 401/6 |
| 5,248,211 | A * | 9/1993 | Holst | 401/7 |
| 5,397,194 | A * | 3/1995 | Yuan et al. | 401/186 |
| 6,007,264 | A * | 12/1999 | Koptis | 401/132 |
| 6,626,599 | B2 * | 9/2003 | De Laforcade | A45D 19/02 132/108 |

* cited by examiner

*Primary Examiner* — David J Walczak
*Assistant Examiner* — Joshua R Wiljanen
(74) *Attorney, Agent, or Firm* — Schwegman, Lundberg & Woessner

(57) ABSTRACT

Methods are provided for automatic cleaning of gripper belts and rollers within a self-service dispensing device. In an embodiment, a cleaning station located in a storage bin of the dispensing device is used to perform the automatic cleaning. The cleaning station is retrofitted into an existing storage bin of the dispensing device. In another embodiment, an interactive slot mechanism of the dispensing device is modified to hold a cleaning case and provide cleaning fluid to clean the belts and/or rollers. In another embodiment, a cleaning case contains a reservoir of cleaning fluid and a pad saturated with the cleaning fluid to clean the internal belts and roller. Furthermore the cleaning case may contain an automatic lid to maintain saturation of the pads and to keep debris from the cleaning case itself.

1 Claim, 4 Drawing Sheets

AUTOMATIC CLEANING AT A SELF-SERVICE DISPENSING DEVICE

CROSS REFERENCE TO RELATED APPLICATION

This application claims the benefit of the filing date of Provisional Application No. 61/425,035, filed Dec. 20, 2010.

FIELD OF THE INVENTION

The present invention relates, generally, to self-service dispensing devices.

BACKGROUND

The methods in which consumers purchase or obtains items continually evolves. This may be seen in the area of procuring media content for private use. For example, a self-service media content dispensing device, such as a kiosk, offers users the advantages of a self-service device where the user operates and completes the transaction. For the service provider of the dispensing device, advantages are realized by operating a device with a small footprint and avoiding the overhead of a retail establishment. The self-service dispensing device is preferably a touch-based computing dispensing device, such as a self-service kiosk that a user may operate through a graphical user interface on a display, and performing selections by touching a particular icon or symbol on the screen. Other methods of selection may be employed such as depressing a particular button in proximity to the display or through the use of a mouse.

The self-service dispensing devices may dispense any variety of items for consumer use including, but not limited to, candies, electronics, media content such as DVDs or CDs, cell phones, food items, beauty items, and sodas. These items are stored within the self-service dispensing device. Components within the self-service dispensing mechanism are designed to move items from the location where the items are stored to a location the items are dispensed. The items may be stored in storage bins or any other area of the dispensing device that may store the item. The dispensing location may be, for example, a slot or port through which an item may be placed. As these self-service dispensing devices become more popular, methods and techniques to improve the consumer experience with these self-service devices becomes more important.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

SUMMARY

Methods are provided for automatic cleaning of a self-service dispensing device. In an embodiment, a predetermined storage bin location in the self-service dispensing device is used as a belt cleaning station so that the self-service dispensing device robotic gripper may automatically clean its gripper belts. After a pre-determined number of dispensing cycles, the gripper is directed to the cleaning station bin location and performs an extended-duration pick operation. In the cleaning station bin, a "cleaning case" designed to be the same size as a media content case is fixed in place. The side surfaces of the "cleaning case" may have either wet or dry materials designed to clean the gripper belt when the gripper belt performs a pick operation at this location. As the gripper performs its extended-duration cleaning pick operation, the belts on the gripper slide against the cleaning surface of the cleaning case, wiping the dust off of the belts. This may be retrofitted to existing self-service dispensing device already in service.

In another embodiment, a cleaning case with cleaning pads is retrieved from a predetermined bin location in the self-service dispensing device. The cleaning case is inserted into an interactive slot mechanism. A container of cleaning solution resides on the interactive slot mechanism. In an embodiment, a measured amount of cleaning solution is deposited on the cleaning pads by the interactive slot mechanism. The interactive slot then holds the cleaning case stationary while the roller mechanism spins on the cleaning pads to remove debris built-up on the roller mechanism. The cleaning case is ejected onto the gripper where the cleaning case is also held stationary while the belts that shuttle the items continue to revolve and are scrubbed. After the scrubbing process of all components that perform item-shuttling is complete, the cleaning case is returned to the predetermined bin location in the self-service dispensing device until the automatic cleaning process is again necessary.

In another embodiment, cleaning solution resides directly in a hollow cleaning case. This allows the cleaning pads of the cleaning case to always be saturated and ready to perform the cleaning. The case may reside in a predetermined bin location in the self-service dispensing device, and the robot in the self-service dispensing device fetches the case to perform the cleaning.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

Figure 1:
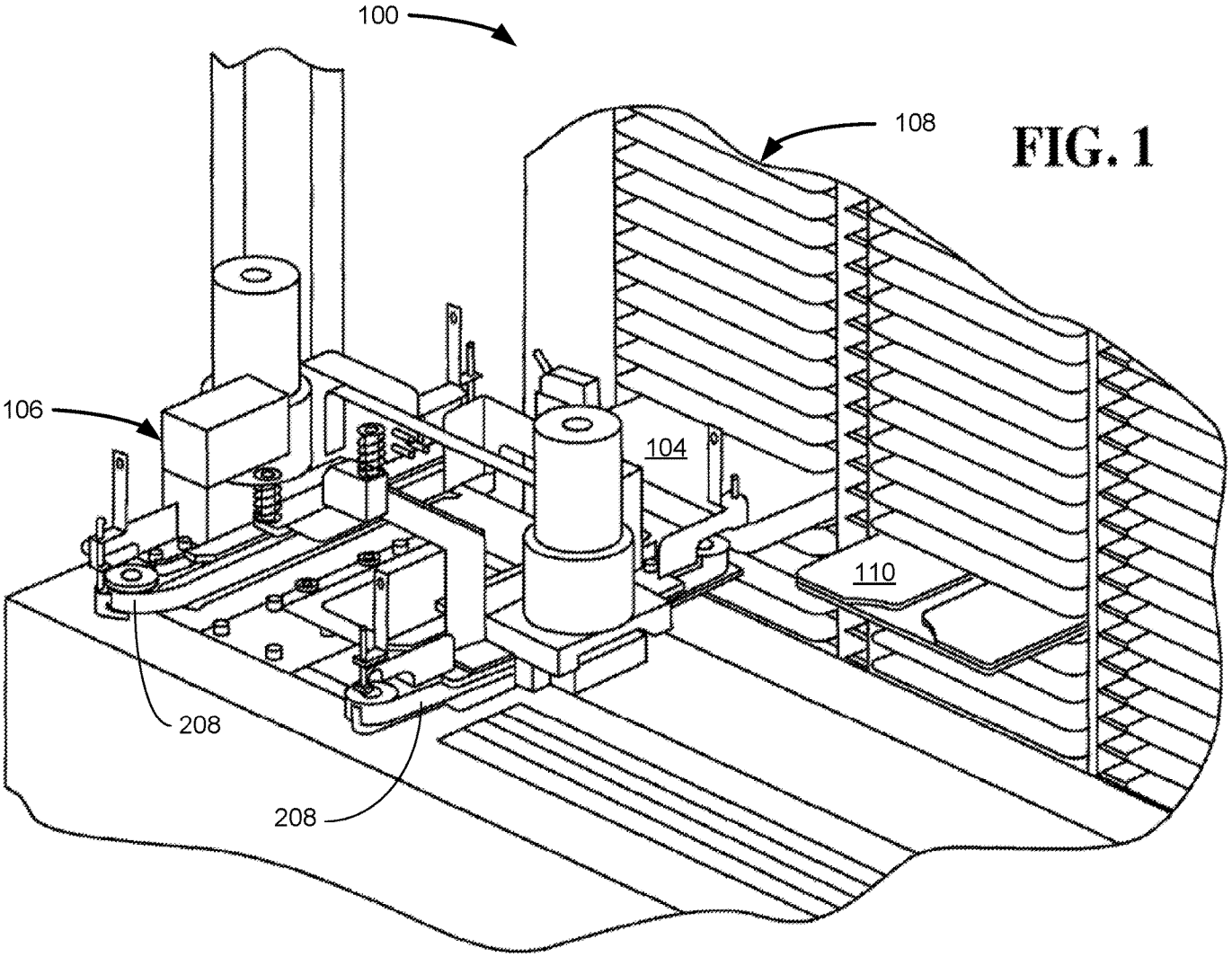
FIG. 1 is an illustration of a system for automatic cleaning of a dispensing device with a cleaning station, according to an embodiment of the invention.

In the following description, for the purposes of explanation, numerous specific details are set forth in order to provide a thorough understanding of the present invention. It will be apparent, however, that the present invention may be practiced without these specific details. In other instances, well-known structures and devices are shown in block diagram form in order to avoid unnecessarily obscuring the present invention.

General Overview

Methods and techniques are described that allow automatic cleaning of the gripping mechanism of a self-service dispensing device. This cleaning is required because field data and experiments show that, over time, dust and other debris builds up on the robotic dispenser of a self-service dispensing device. The dirt and debris may be from the shuttling process of the items in the dispensing device as well as from the handling by the customer. This often occurs with the gripper belts of the robotic dispenser designed to dispense media content in the form of DVD or CD cases. The cases may be standard cases as those sold in retail stores or may be cases that are designed exclusively for use in a particular self-service dispensing device. Gripper belts may be made of a material able to grab items, such as rubber or any synthetic material with a characteristic of high friction. The gripper belts grab the items dispensed by the dispensing device and places these items in a slot or port for dispensing. As the dust and debris builds up, this causes operational issues with the gripper belts. The dust and debris may reduce friction between the gripper belts and items, causing a failure to pick an item or items from their storage bin locations. Unfortunately, such a fault leads the self-service dispensing device out of service, resulting in lost revenue and requiring an expensive service call to return the dispensing device to operational by cleaning the gripper belts. In order to prevent this downtime, a preventive maintenance program to routinely clean the gripper belts before failures occur from dust build-up is important.

In an embodiment, the automatic cleaning system may be activated by a variety of methods. For example, an RFID tag by any service or merchandiser personnel might be presented to the self-service dispensing device to begin the cleaning. In another example, an internal timer mechanism might be maintained and automatic cleaning may be set on a predetermined schedule. In yet another example, if a fault is detected in the self-service dispensing device, a remote service organization may direct the dispensing device to perform an automatic cleaning. In an embodiment, an automatic cleaning routine is started by the firmware without any additional external involvement. This automatic cleaning eliminates costly down time due to dust build-up, service calls, and the need for preventive maintenance service calls, improving customer experience and profitability for the self-service dispensing device.

In an embodiment, a standard item storage bin location that is part of the self-service dispensing device may be used as a gripper belt cleaning station. This allows the self-service dispensing device robotic gripper to automatically clean, at predetermined intervals, its own gripper belts. The intervals may be based upon a predetermined quantity of time or a predetermined number of dispensing cycles. Once either of these milestones is reaches, the gripper may be directed to the cleaning station bin location and perform an extended-duration pick operation. An extended-duration pick operation is a pick operation (as used normally with procuring any item in the dispensing device) performed for an extended amount of time.

Thus, the gripper is directed towards the cleaning station bin location. In an embodiment, a "cleaning case" designed to be the same size as a standard item stored in the dispensing device is fixed in place in the cleaning station bin. In an embodiment, the side surfaces of the "cleaning case" may have either wet or dry materials designed to clean the gripper belt when the gripper belt performs the extended-duration pick operation at the cleaning station bin location. The use of wet or dry materials may vary from implementation to implementation, but may include a liquid cleanser or an abrasive sponge. Furthermore, the actual wet or dry materials used for cleaning may also vary. As the gripper performs its extended-duration cleaning pick operation, the gripper belts may slide against the cleaning surface, wiping any of the built-up dust or debris off of the gripper belts. In an embodiment, the cleaning station bin is retrofitted to self-service dispensing devices already in service in the field.

In another embodiment, a cleaning case with cleaning pads is retrieved from a predetermined bin location in the self-service dispensing device and inserted into an interactive slot mechanism. A container of cleaning solution resides on the interactive slot mechanism and a measured amount of cleaning solution is deposited on the cleaning pads by the interactive slot mechanism. The interactive slot then holds the cleaning case stationary while the roller mechanism spins on the cleaning pads to remove debris built-up on the roller mechanism. The cleaning case is ejected onto the gripper where the cleaning case is also held stationary while the belts that shuttle the items continue to revolve and are scrubbed. After the scrubbing process of all components that perform item-shuttling is complete, the cleaning case is returned to the predetermined bin location in the self-service dispensing device.

In another embodiment, cleaning solution resides directly in a hollow cleaning case. The case may reside in a predetermined bin location in the self-service dispensing device, and the robot in the self-service dispensing device fetches the case to perform the cleaning.

Initiation of Automatic Cleaning

The automatic cleaning process may be initiated through an active command or may be performed on a predetermined schedule. In an embodiment, the automatic cleaning system may be activated by an RFID tag. For example, a support engineer might initiate the automatic cleaning on a service call by presenting an RFID tag to a predetermined area of the self-service dispensing device. In another example, the support engineer might present the RFID tap via a cleaning case. When the cleaning case with the RFID tag is presented into the return slot in the dispensing device, an antenna detects the RFID tag, interprets the RFID tag as a signal to begin the cleaning process, and the dispensing device begins the automatic cleaning process. The dispensing device may have an RFID tag detector already installed to detect returned media content items to the dispensing device. Thus, no additional equipment might need to be installed to initiate automatic cleaning in this manner. The time of cleaning may be delayed such that the RED is presented during the daytime, but the actual cleaning may not occur until late at night to not affect the downtime of the dispensing device. In another embodiment, merchandiser personnel may perform the same presentation of an RFID tag.

In an embodiment, an internal timer mechanism might be maintained and automatic cleaning may be set on a predetermined schedule. For example, the dispensing device might be configured such that an automatic cleaning occurs every five days. When the internal timer registers that five days has passed since the last cleaning, then the dispensing device begins an automatic cleaning. In another embodiment, rather than the schedule being based on time, the schedule is based upon a number of items dispensed. For example, after the dispensing device has performed 100 hundred dispenses, an automatic cleaning may be initiated. In another embodiment, these schedules may be a hybrid of number of dispenses and time. For example, an automatic cleaning would be scheduled for the earlier of the occurrence of 100 dispenses or five days. In an embodiment, the automatic cleanings may also be scheduled to occur during the least busy time for the dispensing device. For example, the automatic cleaning may be schedule for between 2:00 A.M. and 3:00 A.M. in the morning.

In an embodiment, if a fault is detected in the self-service dispensing device, a remote service organization may direct the dispensing device to perform an automatic cleaning. For example, a diagnostic program installed on the dispensing device might alert customer support remotely when a fault occurs in the dispensing device that causes the device to become non-operational. If the fault is a result of dust or debris build-up on the gripper belts, customer support may remotely order the dispensing device to perform an automatic cleaning immediately in order to return the dispensing device to operation. In another embodiment, when a fault is detected that is the result of dust or debris build-up on the gripper belts, the diagnostic program automatically initiates an automatic cleaning of the dispensing device immediately in order to return the dispensing device to operation.

In yet another embodiment, a sensor in the self-service dispensing device detects the amount of debris or dust built up on the gripper or gripper belts. Under this circumstance, when the sensor detects a particular amount of debris built up, the automatic cleaning process may be initiated.

Using Cleaning Station

In an embodiment, a standard item storage bin location that is part of the self-service dispensing device may be used as a gripper belt cleaning station. An extended-duration pick operation is a pick operation (as used normally with procuring any item in the dispensing device) performed for an extended amount of time. In an embodiment, the cleaning station bin is retrofitted to self-service dispensing devices already in service in the field. This lowers costs as existing self-service dispensing devices may be used without the added costs of designing and replacing an entire inventory of self-service dispensing devices.

When automatic cleaning is initiated, the gripper is directed towards the cleaning station bin location with the extended duration pick operation instruction. In an embodiment, a "cleaning case" designed the same size as a standard item (for example, the same size as a DVD case in the case for a dispensing device that dispenses media content) is fixed in place in the cleaning station bin. In an embodiment, the side surfaces of the "cleaning case" may have either wet or dry materials designed to clean the gripper belt when the gripper belt performs the extended-duration pick operation at the cleaning station bin location. The use of wet or dry materials may vary from implementation to implementation, but may include a liquid cleanser or an abrasive sponge. Depending upon the type of debris found (e.g. sand vs. dust, etc.) one type of cleanser may function better than another type of cleanser. Furthermore, the actual wet or dry materials used for cleaning may also vary. As the gripper performs its extended-duration cleaning pick operation, the gripper belts may slide against the cleaning surface of the cleaning case, wiping any of the built-up dust or debris off of the gripper belts.

An illustration of the gripper belts 102 with the cleaning case 104 according to an embodiment is shown in FIG. 1. In FIG. 1, the gripper belts 102 are shown on the dispensing mechanism 106 upon which dust or debris may build. This is an interior view of the self-service dispensing device 100 with storage bins shown (in this particular case, used with media content related items). The cleaning case 104 is fixed in place in a particular storage bin in the set of plurality of storage bins 108. Because the cleaning case 104 is fixed in place, no available inventory of items in the dispensing device 100 is stored in that particular storage bin location. When the gripper belts 102 are placed on the cleaning case 104, the belts 102 are moved against surfaces of the cleaning case 104 to clean the gripper belts 102. A regular item DVD case 110 is also shown in FIG. 1 in order to display that the size of the cleaning case 104 is similar in size and shape to a regular item stored in the dispensing device 100.

Interactive Slot Mechanism

In another embodiment, a cleaning case with cleaning pads is retrieved from a predetermined bin location in the self-service dispensing device. The bin location at which the cleaning case is stored may vary from implementation to implementation. The retrieved cleaning case is then inserted into an interactive slot mechanism (as opposed to the retrofitted storage bin). The slot mechanism is the location in the self-service dispensing device where items are dispensed and/or returned to the self-service dispensing device.

In an embodiment, a container of cleaning solution resides on or in proximity to the interactive slot mechanism. In an embodiment, a measured amount of cleaning solution is deposited on the cleaning pads by the interactive slot mechanism. The interactive slot then holds the cleaning case stationary while the roller mechanism spins on the cleaning pads to remove debris built-up on the roller mechanism. The cleaning case is ejected onto the gripper where the cleaning case is also held stationary while the belts that shuttle the items continue to revolve and are scrubbed. After the scrubbing process of all components that perform item-shuttling is complete, the cleaning case is returned to the predetermined bin location in the self-service dispensing device until the automatic cleaning process is again necessary.

Figure 2:
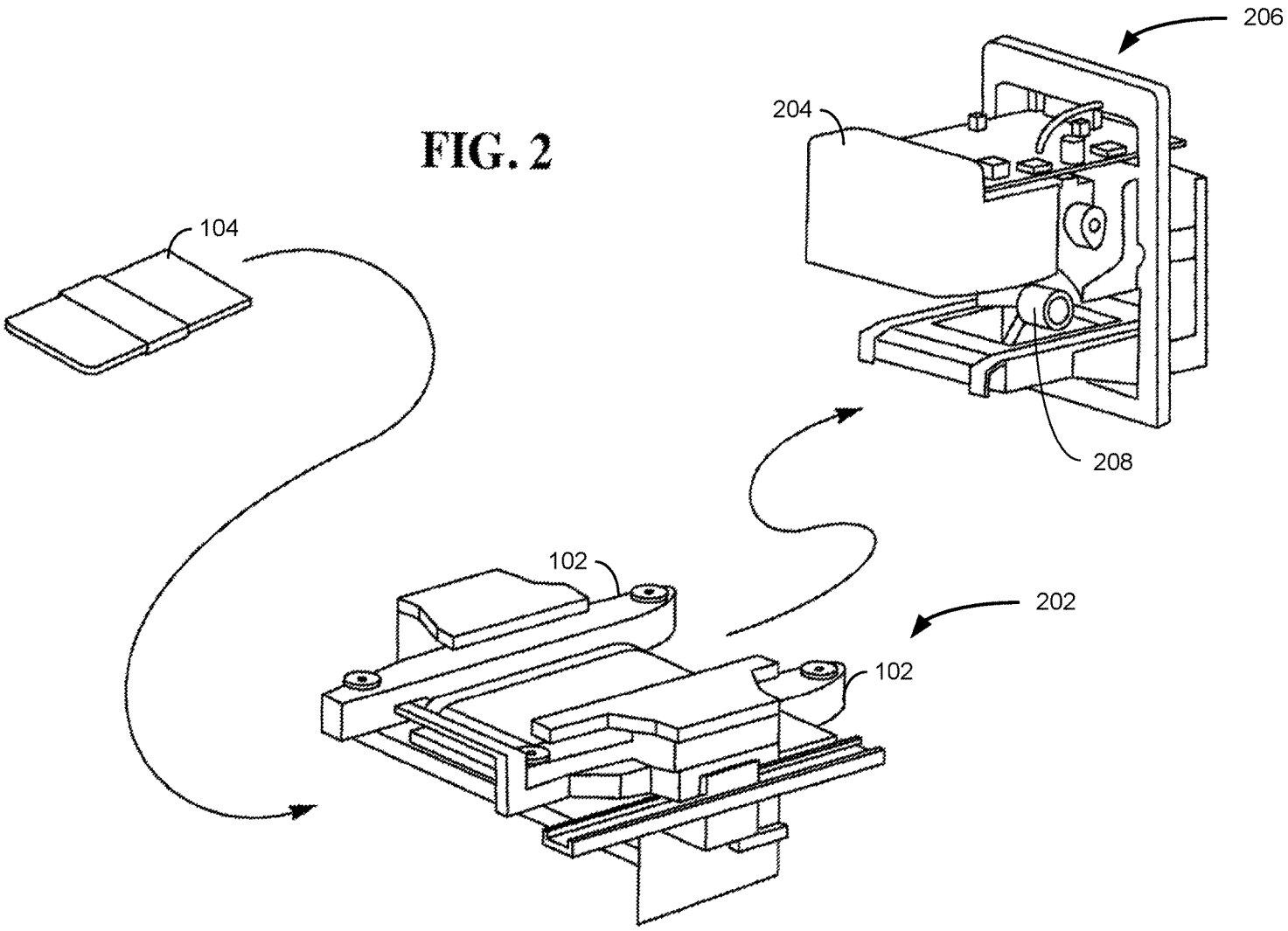
FIG. 2 is an illustration of a system for automatic cleaning of a dispensing device with an interactive slot mechanism, according to an embodiment of the invention.

An illustration of the process is shown in FIG. 2. As illustrated in FIG. 2, a cleaning case 104 is retrieved by the gripper 202. The gripper then places the cleaning case 104 in the interactive slot mechanism 206. The interactive slot mechanism 206 further comprises a container 204 of cleaning fluid. A predetermined amount of cleaning fluid is deposited on cleaning areas of the cleaning case 104 in order to effect cleaning. In an embodiment, the amount of cleaning fluid may vary. For example, a larger amount of debris built up on the gripper 202 or gripper belts 102 may result in a larger amount of cleaning fluid to be deposited onto the cleaning case 104. Smaller amounts of debris yield less cleaning fluid deposited onto the cleaning case 104.

The cleaning case 104 is held in the interactive slot mechanism 206 and the roller 208 surfaces that require cleaning on the interactive slot mechanism 206 are turned. The rollers 208 are scrubbed against the cleaning surfaces of the cleaning case 104 in order to clean the roller 208 and belt 102.

Next, the gripper 202 accepts the cleaning case 104 and is held stationary. The belts 102 on the gripper 202 are then turned and scrubbed by the cleaning case 104 in order to clean the gripper belts 102 on the gripper 202. Once the gripper belts 102 are cleaned, the cleaning case 104 is placed back into a predetermined bin location and held there until another cleaning is required.

Cleaning Case

In an embodiment, cleaning solution may reside directly in a hollow cleaning case. Cleaning pads located on the surface of the cleaning case are thus always saturated and ready to perform cleaning. The cleaning case resides in a predetermined location in the self-service dispensing device. The location may be a storage bin that normally stores items dispensed by the dispensing device or may be a unique location away from the storage bins of the dispensing device.

Figure 3:
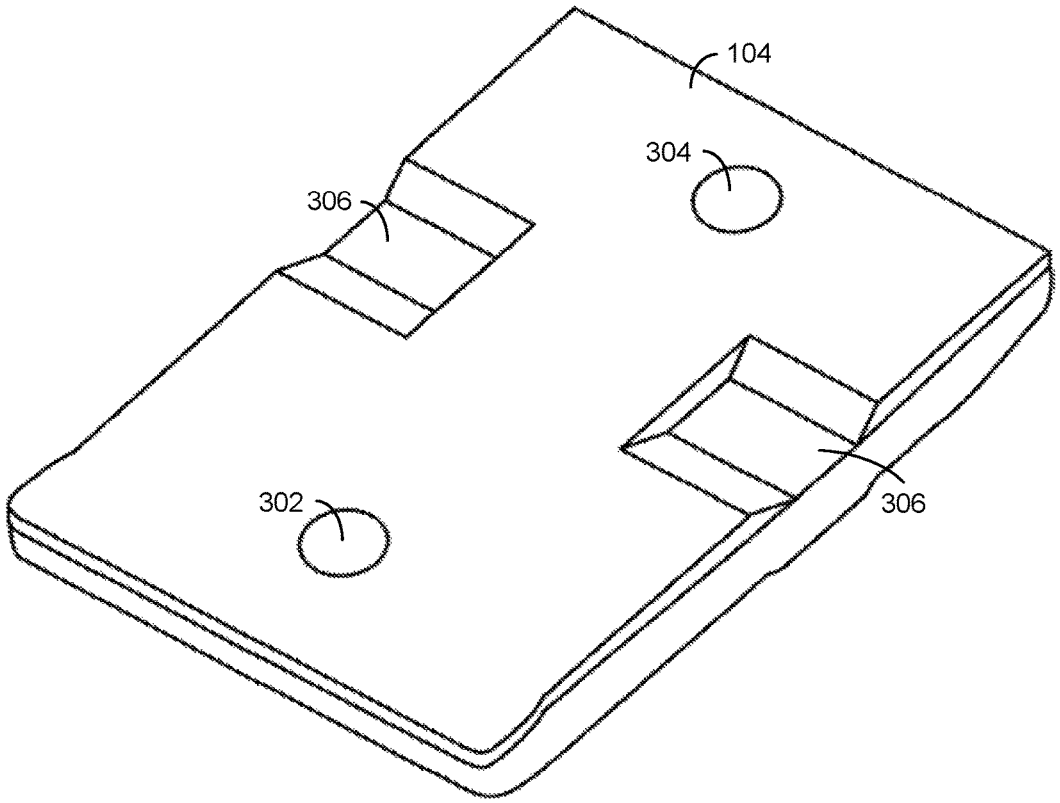
FIG. 3 an illustration of a cleaning case for automatic cleaning of a dispensing device, according to an embodiment of the invention.

In an embodiment, the cleaning case is hollow with a reservoir that may store the cleaning solution. The size of the reservoir may vary based upon the size of the cleaning case. The cases may also vary based upon the type of debris that may occur at a particular geographic location. In an embodiment, a pad with an abrasive cloth saturated with solution allows the solution to be presented to the dirty components. For example, the pad might be comprised of felt and the cloth may comprise of nylon but any types of materials may be used that perform the cleaning process of the pad and cloth. In an embodiment, the cleaning case resides in a dedicated bin location in the kiosk so that it can be accessed at any point in time to clean the dirty, components. An illustration of such a cleaning case 104 is illustrated in FIG. 3. FIG. 3 displays two filling caps 302, 304 to refill the cleaning case 104 with cleaning fluid. The caps 302, 304 are shown on the front and rear of the cleaning case 104. The actual location of the filling caps 302, 304 may vary from implementation to implementation based upon where the filling hoses are for the cleaning fluid on the interactive slot mechanism 206. The cleaning case 104 is also sealed and in the shape of an item that the self-service dispensing device dispenses (in this case, a DVD case). Also disposed on top of the cleaning case 104 is a cleaning pad 306 saturated with cleanser. The pad 306 is a felt core that wicks the solution and a nylon fabric that is lightly abrasive against a roller 208 and/or gripper belt 102 corners the pads 306. Materials of the pad 306 and covering of the pad 306 may vary but should contain similar characteristics of the materials shown herein.

Figure 4:
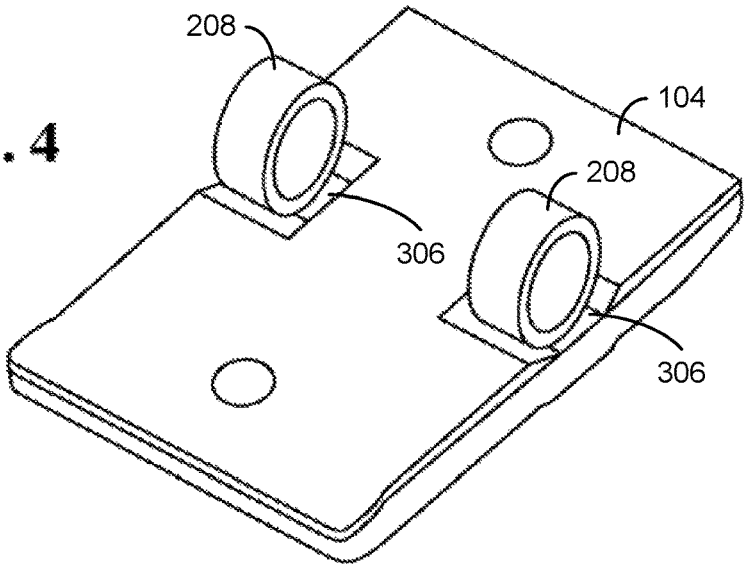
FIG. 4 an illustration of a cleaning case cleaning rollers of a dispensing device, according to an embodiment of the invention.

An illustration of how the cleaning case 104 cleans rollers 208 of the interactive slot mechanism 206 are shown in FIG. 4. In FIG. 4, rollers 208 from the internal motion mechanism of the interactive slot device 206 or gripper 202 are placed on the cleaning pads 306 of the cleaning case 104 and are turned on the cleaning pads 306. The cleaning solution as well as the friction from the nylon covering clear the debris and dust from the rollers 208. Once the rollers 208 and/or belt 102 from the gripper 202 are cleaned by the cleaning case 104, the cleaning case 104 is returned to its predetermined location in the self-service dispensing device 100.

Figure 5:
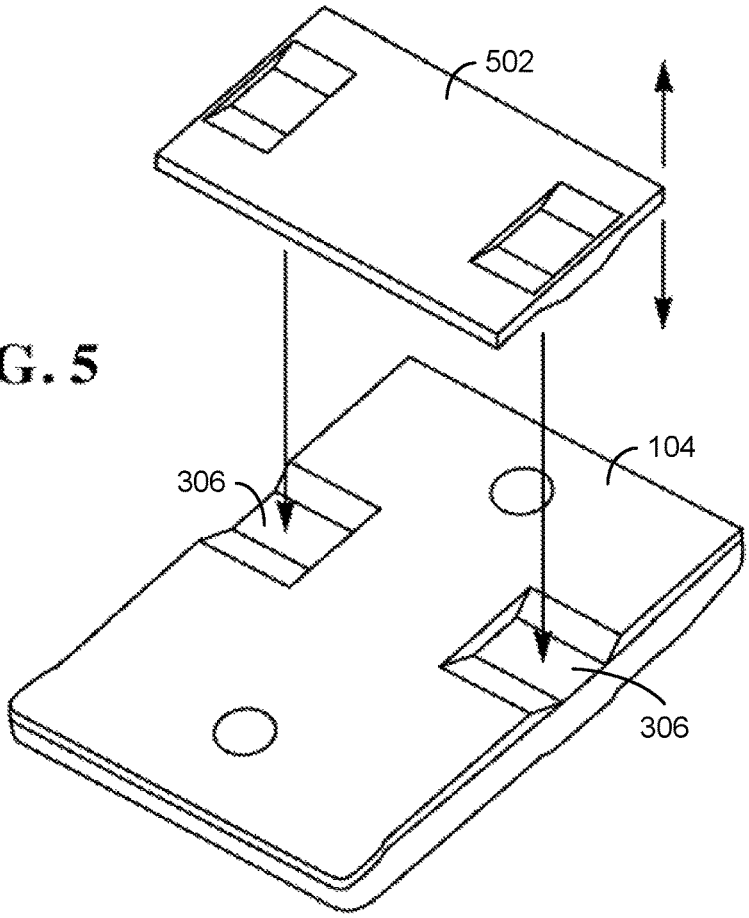
FIG. 5 an illustration of a cleaning case cleaning and a lid for automatic cleaning of a dispensing device, according to an embodiment of the invention.

In an embodiment, the bin location directly above the cleaning case bin location contains a lid system that is automatically removed when the cleaning case is extracted from the cleaning case bin location. The lid system is automatically replaced on top of the cleaning case and completely covers the saturated pads of the cleaning case when the cleaning case is reinserted into the cleaning case bin location. This is shown in FIG. 5. In FIG. 5, the lid 502 is shown hovering above the cleaning case 104 with indentations on which to cover the pad 306 and/or pad coverings when the cleaning case 104 is not in use. This maintains saturation of the cleaning pads 306 with cleaning fluid and also protects the cleaning pads 306 from debris and dust build up as well. The lid 502 is removed upon cleaning and when the cleaning is completed, the lid 502 is replaced on top of the cleaning case 104.

In an embodiment, the on-board wet cleaning capability of the cleaning case system may be accessed remotely or by a service personnel at the self-service dispensing device.

What is claimed is:

1. A cleaning case for cleaning a dispensing device that dispenses items from fixed locations within the dispensing device, the fixed locations having at least one size and shape, the cleaning case sized and shaped according to a size of at least one fixed location and at least one product dispensable therefrom, the cleaning case comprising a hollow reservoir for holding a cleaning fluid and an abrasive pad within the hollow reservoir of the cleaning case the abrasive pad saturated with the cleaning fluid when the cleaning fluid is present, the cleaning case including and exposed only by at least one cleaning port that exposes the abrasive pad saturated with cleaning fluid to a dispensing surface to be cleaned, a number of cleaning ports including the at least one cleaning port and limited to a number of surfaces to be cleaned, each of the at least one cleaning ports sized according to a particular dispensing surface to be cleaned, the abrasive pad saturated with cleaning fluid present on a surface of the cleaning case where exposed by the at least one cleaning port to clean dispensing surfaces of the dispensing device, the cleaning case including at least one filling point to receive cleaning fluid to refill the cleaning case; and wherein the abrasive pad includes a felt core configured to wick the cleaning fluid and a lightly abrasive nylon fabric that is exposed by the at least one cleaning port against the surfaces to be cleaned.

* * * * *